United States Patent [19]

Habfast et al.

[11] Patent Number: 4,641,029

[45] Date of Patent: Feb. 3, 1987

[54] PROCESS AND APPARATUS FOR HEATING IONIZING STRIPS

[76] Inventors: Karl-Eugen Habfast, Kiesselbachstr. 26, D - 2800 Bremen 41; Günter Kappus, Mecklenburgerstr. 37, D - 2805 Stuhr 4; Horst Rache, Brookweg 12, D - 2870 Delmenhorst; Bernd Windel, Wachmannstr. 151, D - 2800 Bremen 1, all of Fed. Rep. of Germany

[21] Appl. No.: 638,758

[22] Filed: Aug. 8, 1984

[30] Foreign Application Priority Data

Aug. 13, 1983 [DE] Fed. Rep. of Germany ..... 3329401

[51] Int. Cl.[4] ..... H01J 49/10

[52] U.S. Cl. ..... 250/288; 250/423 R; 313/15; 313/230; 313/362.1

[58] Field of Search ..... 313/15, 16, 362, 230; 250/288, 289, 423

[56] References Cited

U.S. PATENT DOCUMENTS 2,756,341 7/1956 White ..... 250/423

OTHER PUBLICATIONS

Christie et al., "Reliable Sample Changer . . . ", *Rev. Sci. Instr.* 37(3), Mar. 1966, pp. 336–337.

Rao et al., "Vacuum Lock . . . ", *Journal of Physics E: Sci. Instr.*, vol. 9, 1976, pp. 205–207.

Lubin et al., "Sequential Sample Changer . . . ", *Appl. Spectrosc.* 20(1), 1966, pp. 40–43.

*Primary Examiner*—Bruce C. Anderson

*Assistant Examiner*—Jack I. Berman

*Attorney, Agent, or Firm*—Flehr, Hohbach, Test, Albritton and Herbert

[57] ABSTRACT

Hitherto, ionizing strips (24) arranged on a magazine wheel located in the analyzer head of a mass spectrometer have first been preheated in the measuring position, then heated up and subsequently subjected to the actual measuring operation. The result of this has been that the same time-consuming heating operation has had to be repeated completely for another ionizing strip (24) ready for measurement. It has therefore been impossible to carry out measurements comparing ionizing strips (24) directly. However, to make this possible and, in general, reduce the time for the heating operations considerably, it is proposed that, to generate a stable ion emission, the samples located on the ionizing strips (24) be heated to a specific temperature in a preheating phase and held at this temperature, and thereafter be transferred into a heating-up phase, without the heating operation being interrupted and with the set temperature being maintained, and, after the end of the heating-up phase, subsequently be transferred into a measuring phase, without the heating operation being interrupted and with the set temperature being maintained, thus ensuring that there is always a number of them ready for measurement.

32 Claims, 14 Drawing Figures

Figure 1:
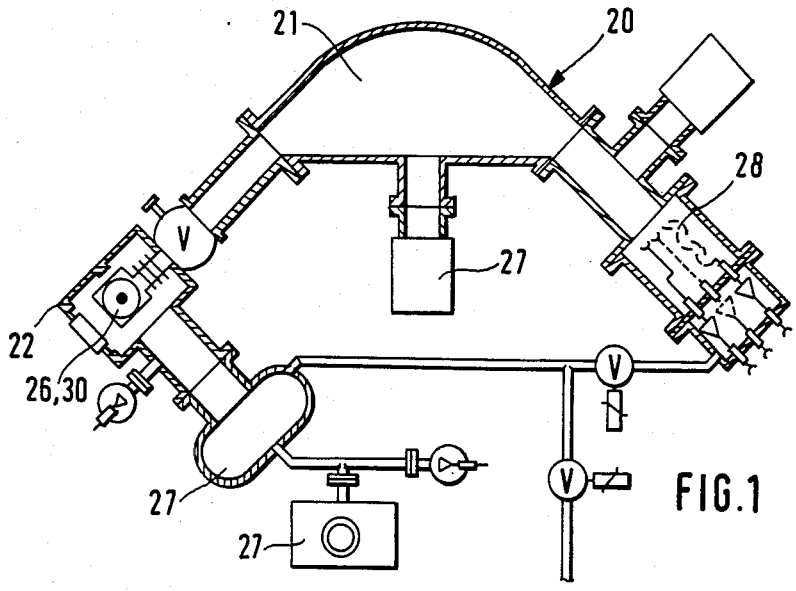

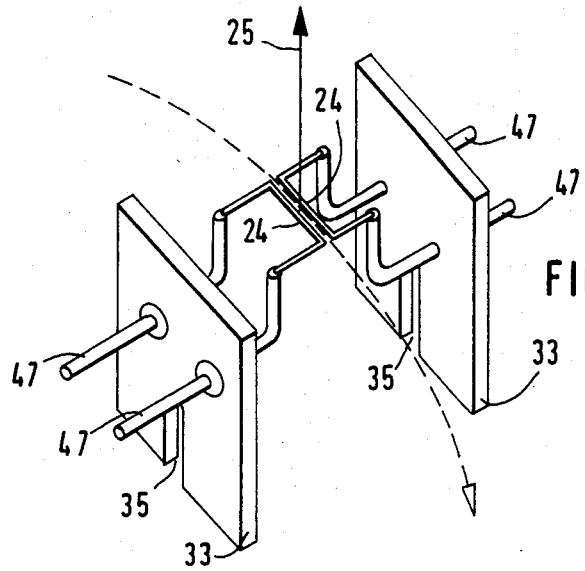
FIG. 4
FIG. 5
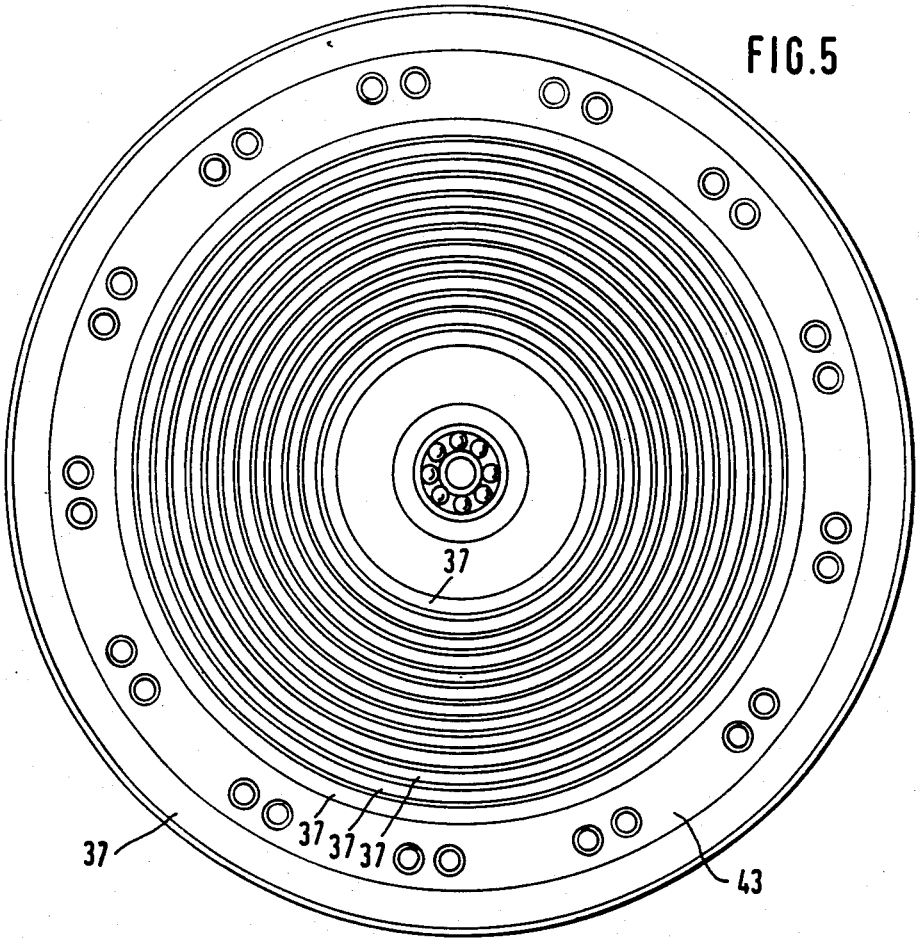

PROCESS AND APPARATUS FOR HEATING IONIZING STRIPS

DESCRIPTION

The invention relates to a process and an apparatus for the heating of, in particular, a plurality of ionizing strips used in mass spectrometers and arranged on a magazine wheel.

The constancy of the ion current emitted is essentially limited by irregularities during the vaporization operation which can be caused by an uneven distribution of samples on the ionizing strips, occluded gas bubbles, etc. Consequently, to achieve sufficient constancy and a high output, it is usually necessary, in precision measurements, to carry out the preheating and heating-up operation very slowly over an hour or more. Not until this relatively lengthy preheating and heating-up process is concluded can the sample prepared in this way undergo actual measurement, and under all circumstances it is necessary for the heating operation to take place continuously and without interruption.

Particularly when a plurality of different samples is to be analyzed, the total time for measuring all the samples is very considerable, since they all have to be heated up in succession in a protracted preheating and heating-up phase and can be measured only subsequently. To avoid the need repeatedly to interrupt the vacuum and restore it again, at least for measuring the samples in a mass spectrometer, a process has become known (the periodical "Isotopics" 12/81; "MAT 261-Magazine") in which a plurality of different samples can be placed on a circular magazine wheel and, after the latter has been equipped with them, can be introduced as a whole into the analyser head of a mass spectrometer. A considerable disadvantage of this known process is that the samples to be analyzed are not supplied with heating energy until they are in the actual measuring position, so that the actual heating-up phase and the subsequent measuring phase last just as long as in the case where samples are introduced individually into an analyzer head, as practised hitherto, and only the time for interrupting and subsequently restoring the vacuum is saved when a magazine wheel equipped with samples is used. The known process is unsuitable for the rapid and highly accurate measurement of a plurality of samples to be analyzed.

The object of the present invention is to provide a process and an apparatus, by means of which large numbers of samples can be measured with, at the same time, high measuring precision, without long heating-up times building up with the quantity of samples to be analysed.

The object is achieved, according to the invention, when, to generate a stable ion emission, the samples located on the ionizing strips are heated to a specific temperature in a preheating phase and held at this temperature, and are thereafter transferred into a heating-up phase, without the heating operation being interrupted and with the set temperature being maintained, and, after the end of the heating-up phase, are subsequently transferred into a measuring phase, without the heating operation being interrupted and with the set temperature being maintained.

In the preheating phase which is also called the conditioning phase, degassing of the sample takes place along other things. During the heating-up phase which serves for homogenizing the sample and for "sintering" the sample to the strip, the ionizing temperature is reached, and consequently the measuring phase can start immediately after the sample has been changed to the measuring position.

Furthermore, to determine the degree of conditioning of the heated-up sample, it is of great advantage briefly to transfer the sample located in the heating-up phase into the position serving for the measuring phase. Thus, the process serves not only for the actual preparation of the samples for measurement, but also for determining the instantaneous state of the sample located in the heating-up phase.

If, preferably, some of the samples to be analyzed constitute standard samples, that is to say samples of known isotope composition, then, to determine the isotope composition of the samples to be analyzed, they are transferred, for comparison with them, into the position serving for the measuring phase. In this way, immediate and direct checking and a comparison are possible in the shortest possible time.

In addition to the necessary check of the prepared samples during heating-up as a result of comparison with the ionizing-strip standards, it can be appropriate, according to a further advantageous embodiment, for the ion current of the samples located in the heating-up phase to be monitored by a separate ion-current measuring device. In this case, a separate mass spectrometer serving as an ion-current measuring device is highly suitable for monitoring the ion current. Preferably, a quadrupole can also be used as an ion-current measuring device.

The apparatus used in this process is designed in such a way that the ionizing strips are connected, via slip-ring devices arranged on the magazine wheel, to current regulators serving for heating the ionizing strips. In this way, the ionizing strips are connected to current regulators simultaneously, so that a predetermined number of them are supplied with heating energy simultaneously in the preheating, heating-up and measuring positions.

Preferably, the magazine wheel incorporates at least one supporting disk on which concentrically arranged collector tracks are formed. According to various other suitable embodiments, the collector tracks can either form closed circles or be made in the form of circular segements to produce a switching zone dependent on the position of an ion-source carrier. If the collector tracks form closed circles, any number of ion sources, selected from outside, can be maintained in the preheating, heating-up and measuring phases, but if the collector tracks are made in the form of circular segments, and thereby constitute a position-dependent switching zone, then, depending on the predetermined constructive design of the switching zone, various samples are maintained in the preheating position and various others in the heating-up and measuring positions as a function of the position of the magazine wheel in relation to a measuring point.

Figure 2:
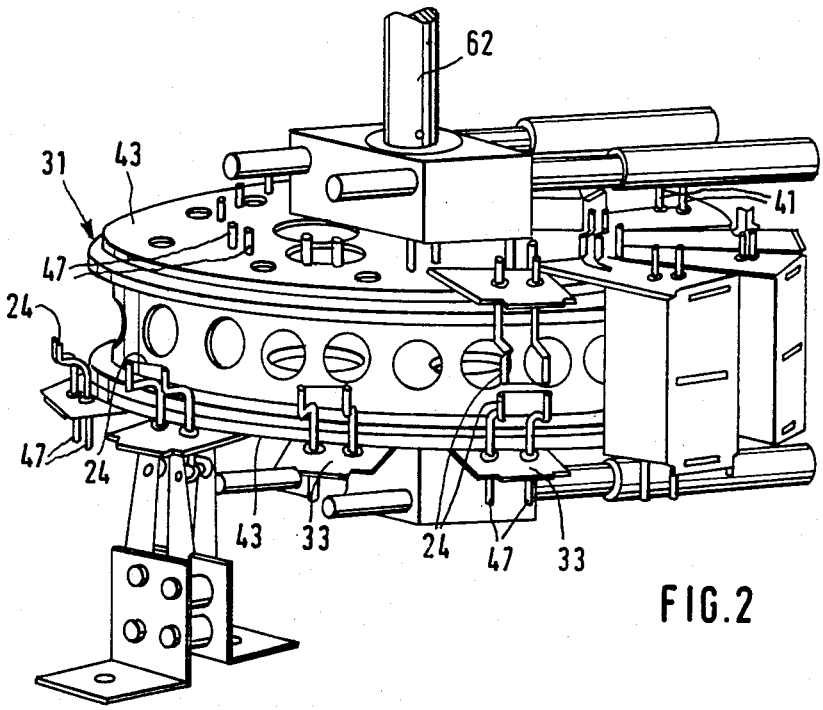
Figure 3:
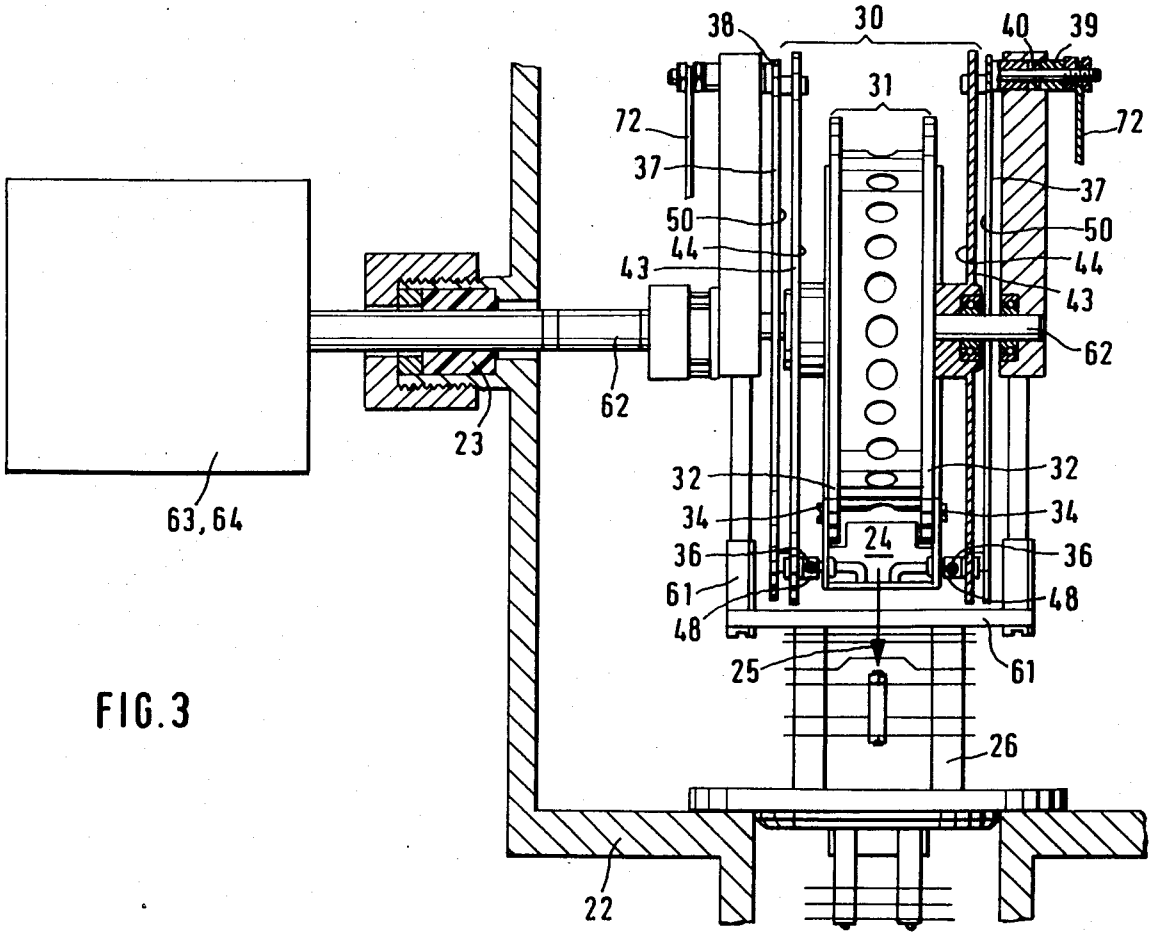
Figure 6:
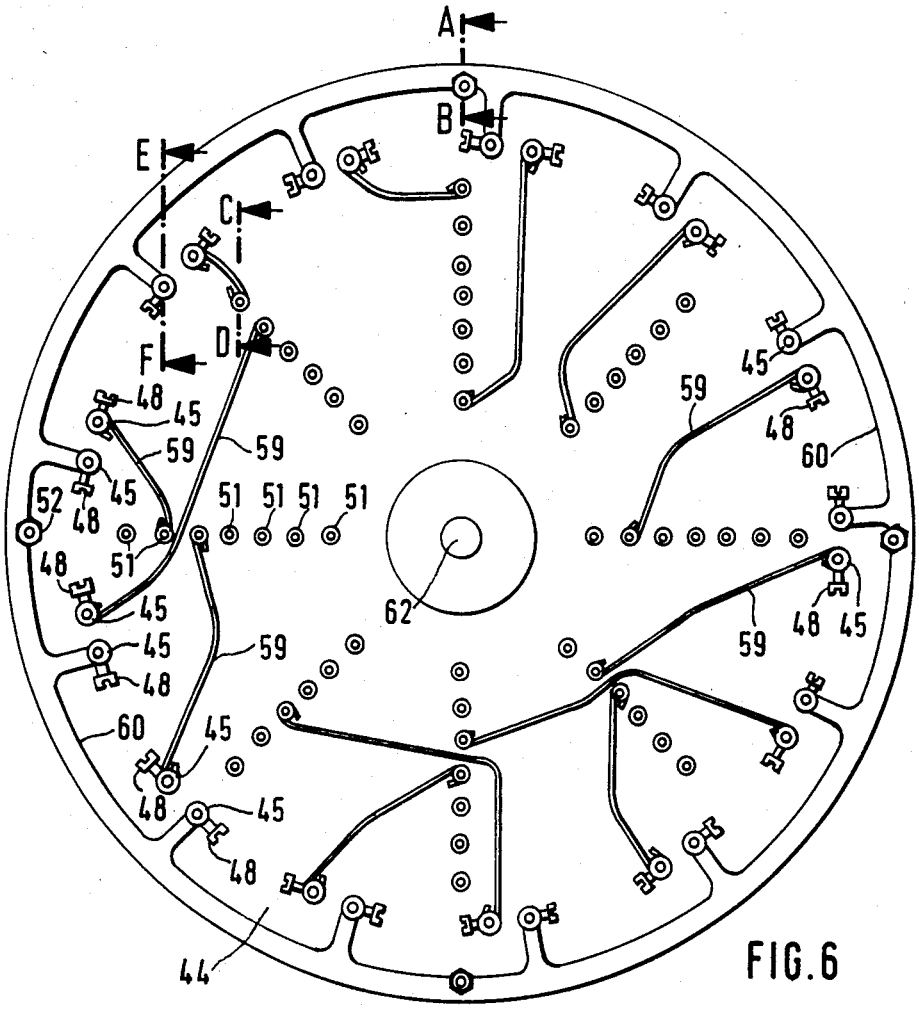
Figure 7:
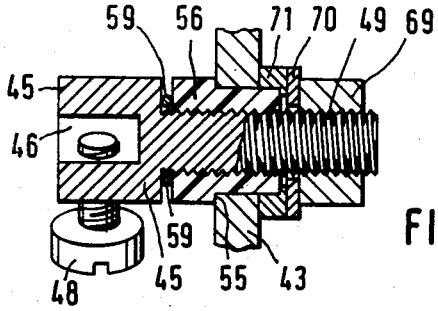
Figure 8:
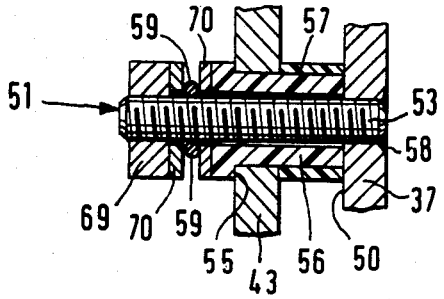
Figure 9:
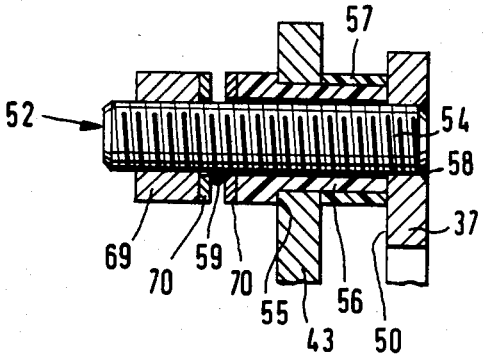
Figure 10:
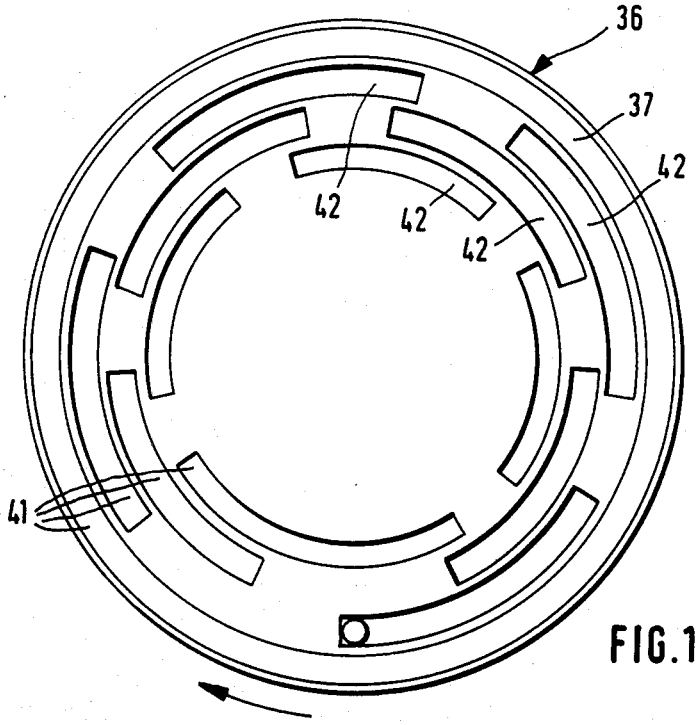
Figure 11:
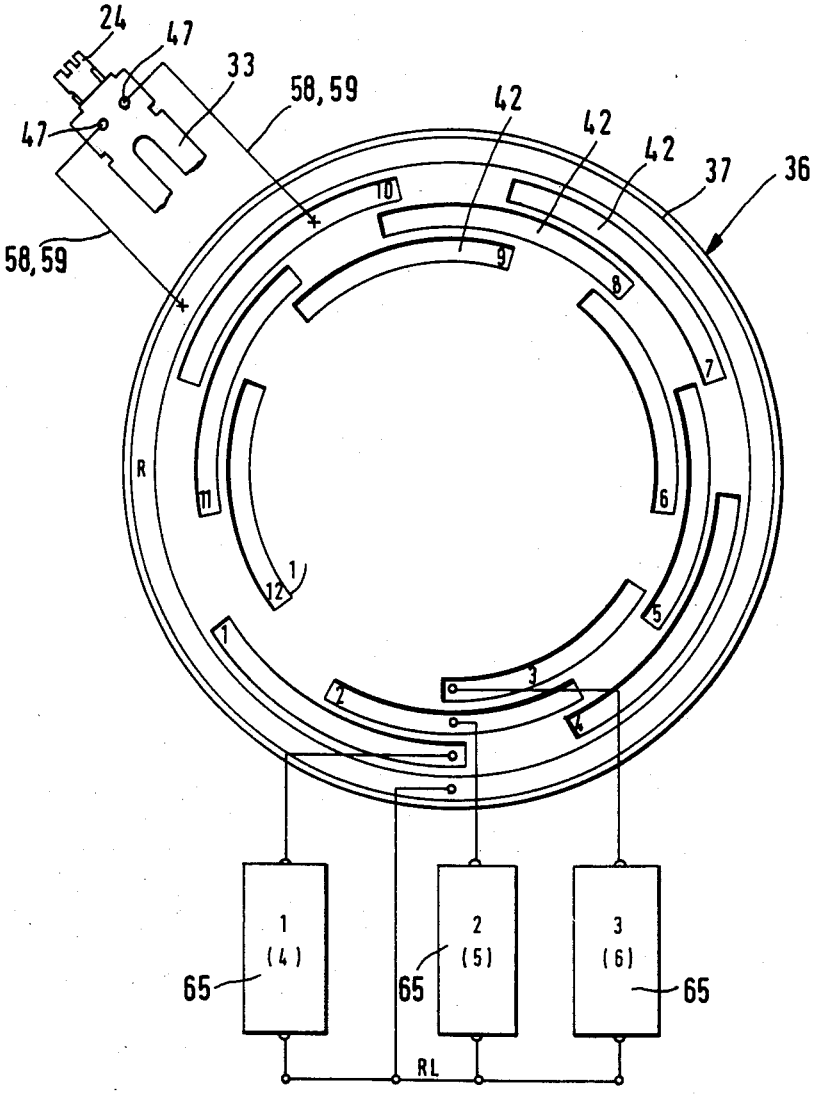
Figure 12:
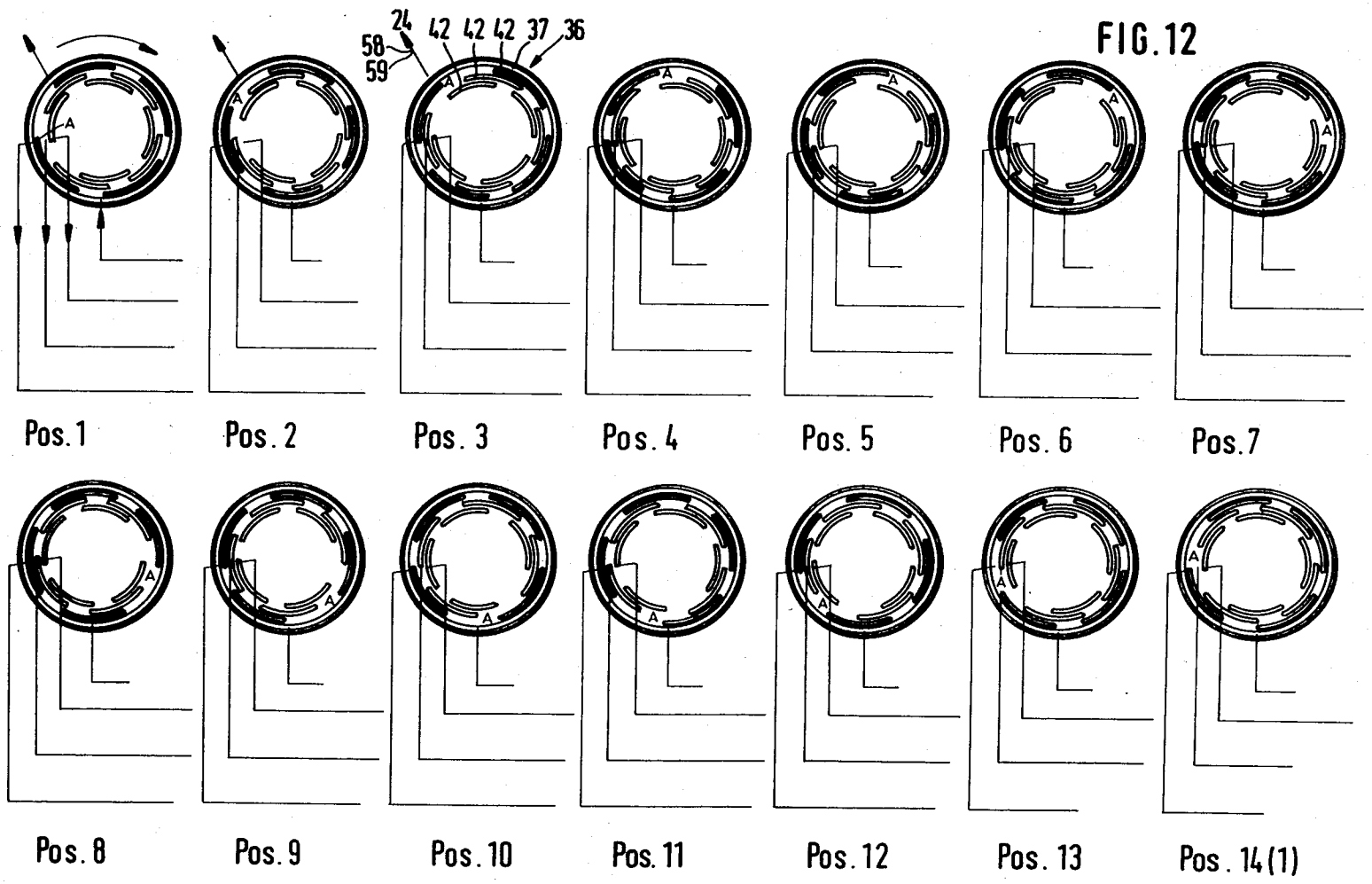
Figure 13:
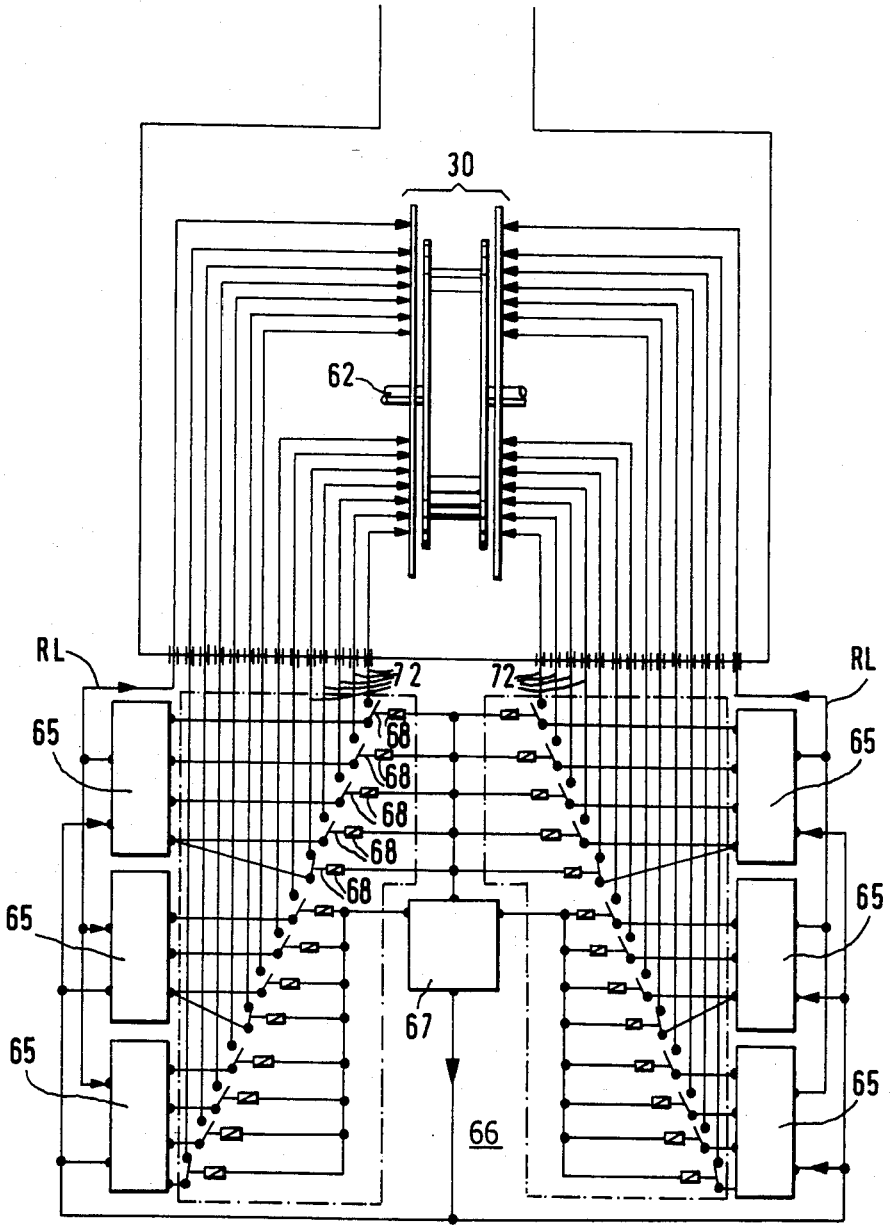
Figure 14:
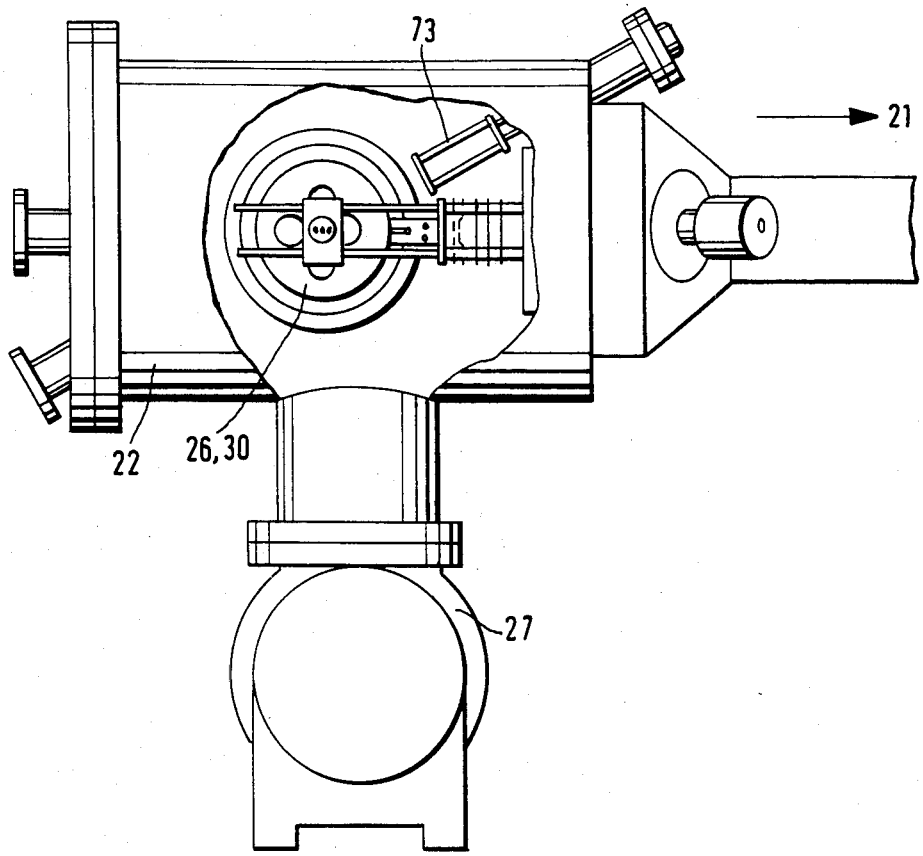

Exemplary embodiments of the invention are explained in more detail below with reference to the drawings in which:

FIG. 1 shows a diagrammatic section through the beam path of a mass spectrometer with a magazine wheel inserted in the analyzer head, FIG. 2 shows, in a perspective representation, a magazine wheel with individual ionizing strips of the known individually heated type which are arranged on the ionizing unit, FIG. 3 shows the magazine wheel arranged in the analyzer head in a partially sectional representation transverse to the plane of rotation, with recurring individual parts being omitted, FIG. 4 shows, in a perspective representation, two ionizing units in their end position fastened to the magazine wheel (not shown), FIG. 5 shows a plan view of a supporting disk and the collector tracks of the magazine wheel which are arranged on it, FIG. 6 shows a plan view of the rear side of the supporting disk illustrated in FIG. 5, with carrier pins and contact pins projecting from it, FIG. 7 shows a section through a carrier pin fastened to the supporting disk, along the line E–F of FIG. 6, FIG. 8 shows a contact pin fastened to the supporting disk, in a section along the line C–D of FIG. 6, FIG. 9 shows a contact pin fastened to the supporting disk, in a section along the line A–B of FIG. 6, FIG. 10 shows the plan view of collector tracks which are made in the form of circular segments and which as a whole form a switching zone for the preheating and heating-up of adjacent ionizing strips, FIG. 11 shows the design of the collector-track switching zone made in the form of circular segments, according to the switching diagram illustrated in FIG. 10, with connected regulating circuits and a connected ion source, FIG. 12 shows the settings of the switching zone of FIG. 11 in positions 1 to 13, FIG. 13 shows a block diagram of a control circuit provided with a computer device, a selection circuit and a regulating circuit and interacting as a whole with a magazine wheel equipped with ionizing strips or samples, and FIG. 14 shows a partially sectional representation of an analyzer head with additional mass spectrometers inserted in it (quadrupole).

The magazine wheel 30, which can be inserted into the analyzer head 22 of a mass spectrometer 20 consisting essentially of an analyzer 21, an analyzer head 22, pumping devices 27, ion collectors 28 and an amplifier system 29, consists essentially of a drum-shaped basic body 31, on the disk-shaped limiting surfaces 32 of which plate-shaped ionizing units 33 are arranged along the periphery of the magazine wheel 30. The ionizing unit 33 is fastened to the disk-shaped limiting surfaces 32 via fastening means 34, in such a way that the contacts 47, which lead through its plate surface essentially at right angles and which receive the ionizing strips 24, allow the latter to project into the ion-emission path 25, as illustrated particularly in FIG. 4 by the solid arrow.

A disk-shaped supporting disk 43 is arranged axially relative to and on both sides of the drum-shaped basic body 31 of the magazine wheel 30. The supporting disk 43 which preferably consists of metal carries collector tracks 37 which, in turn, via sliding contacts 38 arranged on an assembly frame 61, make an electrical connection between the ionizing strips 24 arranged on the ionizing units 33 on the magazine wheel 30.

For this purpose, carrier pins 45 arranged in pairs and projecting on the side 44 of the supporting disk 43 facing away from the collector tracks 37 and vertically relative to this are provided for making the electrical connection between the ionizing strips 24 and the collector tracks 37. The carrier pins 45 have at one end a hole 46 extending in an axial direction, with fastening screws 48 extending transversely to this and intended for receiving a contact 47 of the ionizing strip, whilst they have at their other cylindrical end a threaded extension 49 for fastening in the supporting disk 43.

The carrier pin 46 itself is fastened to the supporting disk 43 by means of a nut 69 via an insulating bush 56 provided with a recess 55 as well as via an insulating spacer bush and a washer 70. Fastened by being clamped between the insulating bush 56 and the carrier pin 45 is a conductor 59, the function of which is described later.

The carrier pins 45 arranged respectively in pairs and supplying the ionizing strips 24 with energy in pairs are arranged on a concentric circular line of the supporting disk 43.

The collector tracks 37 have contact pins 51 which project vertically from their opposite side 50 and which comprise a threaded bolt 53, an insulating bush 56 provided with a recess 55, and a spacer bush 57, the threaded bolt 53 making the connection 58 with the collector tracks 37. The contact pins 51 project through holes formed correspondingly in the supporting disk 43 and are fastened to the supporting disk by means of a nut 69 and washers 70. Clamped between the washers are conductors 59 which each connect the contact pin 51 electrically to a carrier pin 45 assigned to it.

Of basically the same design as the contact pins 51, which are each arranged at a suitable angle and at a suitable distance from one another on the supporting disk 43, there are contact pins 52 on a outer circular line, which in a type of ring circuit each connect one of the carrier pins 45 arranged in pairs via a conductor 59. The outer contact pin 52 is likewise connected 58 to a collector track 57 via the threaded bolt 54. This collector track 37, arranged in the outer peripheral region in the present example, serves as a common return conductor for all the ionizing strips.

FIG. 6, which shows a plan view of side 44 of the supporting disk 43, illustrates the particular allocation of the conductors 59 between the contact pins 51 and the carrier pins 45. Here, each contact pin 51 is connected to a predetermined carrier pin 45, and this means that a predetermined colleetor track 37 is assigned to each carrier pin 45 via the connection of the threaded bolt 53. Because the clamping region of the conductor 59 on the contact pin 51 is designed so as to be releasable, any allocation of a specific pair of carrier pins to a specific collector track 37 is possible.

The collector disk 36, formed as a whole by the individual collector tracks 37 and the supporting disk 43, can consist, as described, of individual conductors separated mechanically from one another, but it can also consist of ceramic material to which metallic collector tracks 37 are applied.

The magazine wheel 30 is connected as a whole, via a magazine axle 62 mounted in an assembly frame 61, to a drive mechanism 63 which is located outside the housing of the analyzer head 22. The magazine axle 62 is sealed off from the housing of the analyzer head 22 by means of a gasket 23 resistant to a high vacuum and designed as a rotary duct. The drive mechanism 63 can be a stepping motor 64. The magazine wheel 30 is connected as a whole to the ion source 24 by means of the assembly frame 61.

The slip-ring devices comprise sliding contacts 38 arranged on the assembly frame 61 in such a way that they can interact with the collector tracks 37. The sliding contacts 38 are displaceable essentially parallel to the magazine axle 62 in bushes 39 made of insulating material, and they are pressed against the collector tracks 37 in order to form a secure contact, by means of the force of a spring 40, with a sliding surface formed at one end. Assigned to each of the collector tracks 37 is a sliding contact 38 which is designed in this way and which is provided at its free end with a feeder line 72 serving to supply voltage.

In addition to the design of the contacts as sliding contacts, it is also possible to use other contact-making methods, for example the most diverse types of engagement contacts.

So that the heating current flowing through the ionizing strips 24 arranged on the magazine wheel 30 can be kept constant, there are current regulators 65 which are adjustable so as to carry out the heating-up operation and keep the temperature of the ion sources constant. It is possible, in principle, to assign a current regulator 65 to each ionizing strip arranged on the magazine wheel 30. Since, on the one hand, it seldom happens in measuring practice that all the ionizing strips 24 arranged on the magazine wheel 30 have to be in the preheating or heating-up phase at the same time, and, on the other hand, the current regulators 65 are very costly devices, it has proved highly appropriate to supply only the particular ionizing strips 24 or samples located in a predetermined time proximity to the measuring operation with a regulated current supplied by the current regulators 65.

The individual current regulators 65 can be allocated by means of permanent wiring, as shown, for example, by the design illustrated in FIGS. 10 and 11, in which the collector tracks 37 are in the form of circular segments as a position-dependent switching zone 35, or else by means of a selection circuit 66, as illustrated in FIG. 13. All the feeder lines 72 leading via the sliding contacts 33, the collector tracks 37 or 42 and the contact pins 51, 52 via the carrier pins 45 to the ionizing strips 24 arranged on the magazine wheel are connected to appropriate terminals of the selection circuit 66.

supplied with regulated voltage and put into a preheated or heated-up state, without the magazine wheel having to be located in a specific position in relation to the measuring position, as in the case of the above-described design of the collector tracks 37 in the form of circular segments.

To select specific ionizing strips 24 arranged on the magazine wheel 30 and to control the regulating sequences of the current regulators 65, it is particularly appropriate to use a computer device 67, by means of which, on the one hand, the selection circuit 66 consisting of relay devices 68 can be controlled to make a connection between the current regulators 65 and the particular collector tracks 37 or ionizing strips 24 assigned to them, and furthermore, likewise, the current regulators can be supplied with control commands to set a specific heating current according to a specific temperature. The computer device 67 can also be used to control the drive mechanism 63 of the magazine wheel 30, so that a rapid change between a sample ready for measurement and a standard ready for measurement can be made as a function of a predetermined measuring program, for the purpose of comparing the unknown isotope composition of the sample with the known isotope composition of the standard.

It is also possible, in specific embodiments of the apparatus, to arrange the position of the preheating phase of the samples and the position of the heating-up phase of samples as a uniform common switching position. In all, current regulators 65 are saved as a result. In this case, current regulation according to the particular phase positions of the sample then takes place directly via the current regulators 65.

The list given below represents the particular preheating, heating-up and measuring positions of twelve ionizing strips 24 which are attached to the magazine wheel 30 and which are supplied via a collector disk 36, as a function of their particular switching position from 1 to 14. This circuit diagram corresponds to a collector disk 36 as illustrated in FIG. 11 and FIG. 12 which show the individual associated switch positions.

| | (Strips) Ionizing strips on magazine wheel | | | | | | | | | | | |
|---|---|---|---|---|---|---|---|---|---|---|---|---|
| Positions | 1 | 2 | 3 | 4 | 5 | 6 | 7 | 8 | 9 | 10 | 11 | 12 |
| 1 | 1 V | | | | | | | | | | | |
| 2 | 1 A | 2 V | | | | | | | | | | |
| 3 | 1 O | 2 A | 3 V | | | | | | | | | |
| 4 | | 2 O | 3 A | 1 V | | | | | | | | |
| 5 | | | 3 O | 1 A | 2 V | | | | | | | |
| 6 | | | | 1 O | 2 A | 3 V | | | | | | |
| 7 | | | | | 2 O | 3 A | 1 V | | | | | |
| 8 | | | | | | 3 O | 1 A | 2 V | | | | |
| 9 | | | | | | | 1 O | 2 A | 3 V | | | |
| 10 | | | | | | | | 2 O | 3 A | 1 V | | |
| 11 | | | | | | | | | 3 O | 1 A | 2 V | |
| 12 | | | | | | | | | | 1 O | 2 A | 3 V |
| 13 | | | | | | | | | | | 2 O | 3 A |
| 14 | | | | | | | | | | | | 3 O |

V = Preheating;
A = Heating-up;
O = Measurement
1 = First regulating circuit 65,
2 = Second regulating circuit 65,
3 = Third regulating circuit 65

Located in the selection circuit 66 are relay devices 68 which, being controlled in an appropriate way, make a connection between the current regulators 65 and the particular collector tracks 37 assigned to them or the ionizing strips 24 assigned to them. In this way, as a result of suitable selection and control, each ionizing strip 24 arranged on the magazine wheel 30 can be A second collector disk 36, which is arranged coaxially and as a mirror image relative to the first and which comprises a correspondingly arranged supporting disk 43, carrier pins 45 and contact pins 51, makes it possible, in principle, to allocate in an identical or different way the ion sources provided there in relation to the preheating phase, the heating-up phase and the measuring phase, as a function of the positions 1 to 14.

By means of the design of the magazine wheel 30 according to the invention, it is possible, with a very wide range of variations, to fix, according to the desired preheating, heating-up and measuring phases, a very wide variety of these phase sequences either constructional or as a result of actual control, so that the desired reduction, according to the object of the invention, in the time spent in heating and measuring a plurality of ionizing strips 24 arranged on the magazine wheel 30 is achieved with very great success.

A general contribution to a further reduction in the time spent as desired according to the object of the invention, is obtained if the temperature of the sample in the working phase is measured by a separate temperature-measuring device which can consist of a pyrometer, so that, on the one hand, continuous temperature monitoring is possible and, on the other hand, there is no need for changeovers into the measuring position which, taken together, amount to a small, but nevertheless significant time factor. For this reason, a pyrometer is assigned not only to the sample in the measuring position, but also the sample in the heating-up position.

What is claimed is:

1. A process for the heating of a plurality of ionizing strips having samples thereon used in mass spectrometers, having an ion emission path, and arranged on a magazine wheel to generate a stable ion emission, comprising the following steps:

preheating said samples located on the ionizing strips to a specific temperature and holding at this temperature; thereafter, without the heating operation being interrupted heating-up said samples toward an ionizing temperature; and, after said ionizing temperature has been reached subsequently transferring said samples into a measuring position juxtaposed with said ion emission path without the heating operation being interrupted including the period while said transfer is taking place.

2. A process as in claim 1 wherein the physical position of the samples while being preheated and heated-up is the same.

3. A process as in claim 1 where a sample being heated-up is briefly transferred into the measuring position in order to determine its degree of conditioning.

4. A process as in claim 1 wherein, to determine the isotope composition of the samples to be analyzed, standards having a known isotope composition are located on some of the ionizing strips which, for comparison with the samples, are transferred into the measuring position.

5. A process as in claim 1 wherein the ion current of the samples being heated-up is monitored by an ion-current measuring device different than said ion emission path.

6. A process as claimed in claim 5 wherein the ion current is monitored in a separate mass spectrometer serving as an ion-current measuring device.

7. A process as claimed in claim 5 wherein monitoring is carried out in a quadrupole serving as an ion-current measuring device.

8. A process as claimed in claim 1 wherein the temperature of the sample being heated-up is measured by a separate temperature-measuring device.

9. A process as claimed in claim 8 wherein the temperature-measuring device is a pyrometer.

10. An apparatus for heating of a plurality of ionizing strips used in mass spectrometers having an ion emission path and arranged on a magazine wheel comprising a plurality of ionizing units connected, via slip-ring means arranged on the magazine wheel, to current regulators serving for heating the ionizing strips including preheating said strips and for thereafter heating said strips to an ionizing temperature and thereafter maintaining such temperature when and as a said strip is moved into a measuring position juxtaposed with said ion emission path.

11. An apparatus as in claim 10 wherein the magazine wheel incorporates at least one collector disk on which concentrically arranged collector tracks are formed.

12. An apparatus as in claim 11 wherein the collector tracks form closed circles.

13. An apparatus as in claim 11 wherein the collector tracks are made in the form of circular segments to produce a switching zone dependent on the ionizing unit.

14. An apparatus as in claim 11 wherein the magazine wheel incorporates at least one collector disk arranged parallel to it.

15. An apparatus as in claim 11 wherein carrier pins arranged in pairs and projecting on the side of said collector disc facing away from the collector tracks and vertically relative to it are provided for connecting the ionizing strips electrically to the collector tracks.

16. An apparatus as in claim 15 wherein the carrier pins have at one end a hole extending in an axial direction, with fastening means extending transversely to it and intended for receiving a contact of the ionizing strips, while they have at their other cylindrical end a threaded extension for fastening in the supporting disk.

17. An apparatus as claimed in claim 15 wherein the carrier pins are arranged on a concentric circular line of the supporting disk.

18. An apparatus as in claim 11 wherein the collector disk has contact pins which project vertically from its side opposite the side provided with collector tracks and which are connected conductively to the collector tracks.

19. An apparatus as in claim 18 wherein the contact pins comprise a threaded bolt, an insulating bush provided with a recess, and a spacer bush, the threaded bolt making the connection with the collector tracks.

20. An apparatus as in claim 18 wherein the contact pin is connected electrically via a conductor to one of a plurality of carrier pins.

21. An apparatus as in claim 11 wherein the magazine wheel incorporates a second collector disk arranged coaxially and as a mirror image relative to the first, with a correspondingly arranged supporting disk and with carrier pins and contact pins.

22. An apparatus as in claim 10 wherein the magazine wheel is connected to a drive mechanism via a magazine axle mounted in an assembly frame.

23. An apparatus as in claim 22 wherein the drive mechanism is a stepping motor.

24. An apparatus as in claim 22 wherein the drive mechanism is a servo-motor.

25. An apparatus as in claim 11 wherein the slip-ring means incorporates sliding contacts which are arranged on an assembly frame and which interact with the collector tracks of the collector disk.

26. An apparatus as in claim 10 wherein said current regulators are used to carry out a heating-up operation and to keep the ionizing-strip temperature constant.

27. An apparatus for the heating of a plurality of ionizing strips used in mass spectrometers and arranged on a magazine wheel comprising a plurality of ionizing units connected, via slip-ring means arranged on the magazine wheel, to current regulators serving for heating the ionizing strips said ionizing strips being connected to the current regulators by means of a selection circuit.

28. An apparatus as in claim 27 wherein the selection circuit is controlled by a computer device.

29. An apparatus as in claim 27 wherein the selection circuits are formed essentially by relay devices.

30. An apparatus as in claim 26 wherein three current regulators are provided.

31. An apparatus as in claim 26 wherein six current regulators are provided.

32. An apparatus as claimed in claim 28 wherein the current regulators, the selection circuit, and the computer device are arranged offset from an analyzer head of a mass spectrometer.

* * * * *